US007750226B2

(12) United States Patent
Banks

(10) Patent No.: US 7,750,226 B2
(45) Date of Patent: Jul. 6, 2010

(54) PAGE TURNER

(75) Inventor: Michael Donald Banks, Ashbourne (GB)

(73) Assignee: Derby Hospitals NHS Foundation Trust, Derby (GB)

( * ) Notice: Subject to any disclaimer, the term of this patent is extended or adjusted under 35 U.S.C. 154(b) by 720 days.

(21) Appl. No.: 11/603,253

(22) Filed: Nov. 22, 2006

(65) Prior Publication Data

US 2007/0158524 A1 Jul. 12, 2007

(30) Foreign Application Priority Data

Nov. 26, 2005 (GB) ..... 0524102.1

(51) Int. Cl.
*G10G 7/00* (2006.01)

(52) U.S. Cl. ..... 84/489

(58) Field of Classification Search ..... 84/486–315
See application file for complete search history.

(56) References Cited

U.S. PATENT DOCUMENTS

| | | | |
|---|---|---|---|
| 2,540,244 | A | 2/1951 | Campbell |
| 3,939,587 | A | 2/1976 | Weststrom |
| 4,084,468 | A | 4/1978 | Butler |
| 4,121,361 | A | 10/1978 | D'Arcy |
| 4,463,651 | A | 8/1984 | Hammer |
| 4,553,467 | A | 11/1985 | Goldner |
| 4,644,675 | A | 2/1987 | Berger et al. |
| 4,677,778 | A | 7/1987 | Sorimachi et al. |
| 4,685,374 | A | 8/1987 | Goldner |
| 4,882,969 | A | 11/1989 | Ricca |
| 5,149,046 | A | 9/1992 | Kerley et al. |
| 5,471,277 | A | 11/1995 | Fujioka et al. |
| 5,612,791 | A | 3/1997 | Turner et al. |
| 5,962,801 | A | 10/1999 | Bowman et al. |
| 6,049,033 | A | 4/2000 | Dallas |
| 6,574,014 | B2 | 6/2003 | Mandel et al. |
| 6,590,148 | B1 | 7/2003 | Medina |
| 6,611,362 | B2 | 8/2003 | Mandel et al. |
| 2002/0044158 | A1 | 4/2002 | Peyser et al. |
| 2002/0046214 | A1 | 4/2002 | Sandifer |
| 2002/0116421 | A1 | 8/2002 | Fox et al. |

(Continued)

FOREIGN PATENT DOCUMENTS

| | | | |
|---|---|---|---|
| EP | 0 212 498 | A2 | 3/1987 |

(Continued)

OTHER PUBLICATIONS

"Automatic Page Turner for Children", NHS Innovations, Apr. 20, 2005, Fifth National NHS Innovation Conference and Exhibition (Press Release).

(Continued)

*Primary Examiner*—Kimberly R Lockett
(74) *Attorney, Agent, or Firm*—Dickstein Shapiro LLP

(57) ABSTRACT

A device for turning one or more pages of book comprising a plurality of pages, the device comprising:

a book support;

a device support for supporting:

first page-flattener for flattening a first page;

second page-flattener for further flattening the first page;

a page ruckler for ruckling the first page to form a ruckled page having an exposed surface and an opposite, unexposed surface;

a page turner for engaging with the unexposed surface of the ruckled page thereby to turn the ruckled page;

positioning means for moving the device support relative to the book support.

33 Claims, 12 Drawing Sheets

U.S. PATENT DOCUMENTS

| | | | | |
|---|---|---|---|---|
| 2002/0121585 | A1 | 9/2002 | Scott et al. | |
| 2003/0024375 | A1 | 2/2003 | Sitrick et al. | |
| 2003/0063334 | A1 | 4/2003 | Mandel et al. | |
| 2003/0063335 | A1 | 4/2003 | Mandel et al. | |
| 2003/0069812 | A1 | 4/2003 | Yuen et al. | |
| 2003/0100965 | A1 | 5/2003 | Sitrick et al. | |
| 2003/0110925 | A1 | 6/2003 | Sitrick et al. | |
| 2003/0110926 | A1 | 6/2003 | Sitrick et al. | |
| 2003/0113015 | A1 | 6/2003 | Tanaka | |
| 2003/0178281 | A1 | 9/2003 | Goto et al. | |
| 2005/0189465 | A1* | 9/2005 | Matsuoka | 248/451 |

FOREIGN PATENT DOCUMENTS

| | | | |
|---|---|---|---|
| GB | 182 181 | A | 6/1922 |
| JP | 11-157252 | | 6/1999 |

OTHER PUBLICATIONS http://www.possum.co.uk/GEWA/Index.htm.
http://web.mit.edu/newsoffice/nr/1999pageturner.html.
http://epics.ecn.purdue.edu/wcme/projects/page%20turner/pt_description.htm.
http://www.robotics.lu.se/publications/1995/bolmsjo95b/HTML/node5.html.
http://www.j-d.co.jp/4_fks/readable/r_top_e.html.
Design.bme.uconn.edu/fall99/RDuncan/public_html/RduncanProposal.doc.
http://store.accesstr.com/page.cfm/PageID/116.
Great Britain Search Report for Application No. GB0524102.1, Issued Feb. 27, 2007.

* cited by examiner 15
30
48
58
60
54
52
46
2
10
16
800
20
24
26
14
28
32
38
42
18
40
44
22
34
12

PAGE TURNER

This invention relates to a device for turning pages of a book, and particularly, but not exclusively, to a device to allow children or disabled people to read books independently.

Such a device may also be useful in assisting musicians to turn pages of sheet music when they may be using both hands to play their instrument.

Similarly, the device may be used to turn the pages of a recipe book when the hands of the cook are not clean.

The invention also relates to a method of turning the pages of a book.

The term "book" as used herein is to be understood to encompass any similar object such as a magazine, pamphlet, sheet music and the like.

A problem exists with many known page turning devices in that from time to time pages can be damaged during the page turning process.

According to a first aspect of the present invention there is provided a device for turning one or more pages of a book comprising a plurality of pages, the device comprising:

a book support;

a device support for supporting:

first page-flattener for flattening a first page;

second page-flattener for further flattening the first page;

a page ruckler for ruckling the first page to form a ruckled page having an exposed surface and an opposite, unexposed surface;

a page turner for engaging with the unexposed surface of the ruckled page thereby to turn the ruckled page;

positioning means for moving the device support relative to the book support.

The term "ruckle" as used herein is intended to mean that at least a portion of the unexposed surface of a page being ruckled is puckered, thereby causing the page to, at least partially, move out of contact with an adjacent page, or adjacent part of the book.

It has been found by the inventor that flattening the first page prior to ruckling the first page greatly reduces the unwanted possibility of inadvertently ruckling other pages below the first page, at the same time.

Preferably the book support comprises a raised portion.

Advantageously the raised portion is in the form of a ridge.

Due to the presence of the raised portion, when a book is placed on the book support, it is positioned such that the ridge causes the first page, which is the page to be turned at any given time, to have a slightly convex upper surface. This assists the page ruckler in ruckling the first page.

The positioning means may be used to either move the device support array from the book support, or vice versa.

The device support may be moved linearly relative to the book support. Alternatively, the relative movement may be rotational.

When the page turner turns a ruckled page, the positioning means causes the device support, and hence the first and second page-flatteners, the page ruckler and the page turner to move away from the book support. This has the effect of reducing a pressure applied to the first page by one or more of the first page-flattener, the second page-flattener and the page ruckler. In addition, the movement of the device support relative to the book support causes the page turner to lift the ruckled page thereby providing a contribution to the turning of the page. Because the pressure applied to the page is reduced, the lifting and turning process is assisted, and it is less likely that the page turner will cause tearing of the page during the turning process. In addition, the movement of the device support relative to the book support maintains a large radius for the ruckled page, where the page turner contacts the first page, and so further reduces the chances of tearing the page.

The large radius for the ruckled page means that the page behaves substantially as a spring. In other words, the page straightens out naturally once turned, as opposed to being creased or sheared which involves structural failure of the page.

Advantageously, the device further comprises a third page-flattener for flattening a second page.

Once the first page has been turned it effectively becomes the second page, and the third page-flattener flattens the second page in order that a user of the device may views or read the newly turned second page.

Advantageously, the positioning means comprises a lifter for lifting the device support away from the book support. The lifter may effect either linear, or rotational movement of the device support.

Preferably, the first page-flattener also comprises the page ruckler, and forms a combined page-flattener and ruckler. This reduces the number of components in the device.

The book may take any form, but typically will comprise a central spine supporting the pages of the book.

Conveniently, the combined page-flattener and ruckler comprises a friction wheel adapted to bear onto the exposed surface of the first page, which wheel is rotatable about an axis spaced apart from, and substantially parallel to a spine of the book, and wherein rotation of the wheel in a first sense causes the first page to flatten, and rotation of the wheel in an opposite sense causes the first page to ruckle.

Thus, when it is required to flatten the page, for example, after a preceding page has been turned, the wheel is caused to rotate in a sense which moves an outer edge of the page away from the spine of the book. This causes the page to flatten, which helps to ensure that the page is appropriately positioned for reading or viewing.

Advantageously, the device further comprises rotating means for rotating the combined page-flattener and ruckler in the appropriate sense.

Conveniently, the combined page-flattener and ruckler is spaced apart from the book support, and the device further comprises an adjustment to compensate for different thicknesses of books.

Advantageously, the device comprises an adjuster for adjusting the lateral distance between the second page-flattener and the combined page flattener and ruckler, and the spine of the book.

The adjuster enables the position of the second page flattener to be varied with respect to the spine of the book and the combined page flattener and ruckler. The position of the second page flattener may be controllably positioned. This allows thicker books to be used with the device according to the present invention.

The adjuster may be either manually controllable, mechanically controllable or electronically controllable.

In a preferred embodiment, once the lateral distance between the second page flattener and the combined page flattener and ruckler has been fixed in accordance with the dimensions of the book to be used with the device, the second page flattener and combined page flattener and ruckler will move in a coordinated and simultaneous manner.

The second page flattener preferably remains substantially central relative to the pages and spine of the book during use of the device.

Preferably, the device further comprises a detector for detecting when the height of the ruckled page relative to the book support reaches a predetermined value.

Once the predetermined value has been detected, the page turner moves to engage with the unexposed surface of the ruckled page. The positioning means is then activated to move the device support away from the book support. This results in the combined page-flattener and ruckler no longer bearing down on the page. In addition, the page turner is moved away from the book support, thus maintaining a large radius for the ruckled page as the page is turned.

Preferably, the second page-flattener comprises a first elongate member spaced apart from the book support, and lying in a plane substantially parallel to the plane of the book support, the first elongate member being rotatable about an axis substantially perpendicular to the axis of rotation of the combined page-flattener and ruckler, and adapted, in use, to bear down on the first page.

The second page-flattener serves to flatten a first page prior to being turned by the page turner.

Preferably, the third page-flattener comprises a second elongate member spaced apart from the book support, and lying in a plane substantially parallel to the plane of the book support, the second elongate member being rotatable about an axis substantially perpendicular to the axis of rotation of the combined page-flattener and ruckler, and adapted, in use, to bear down on the second page.

The second page will have been the most recently turned first page, and the third page-flattener serves to flatten this page once it has been turned. This helps to ensure that the page is appropriately positioned for reading or viewing.

Preferably, the page turner comprises a third elongate member spaced apart from the support and lying in a plane substantially parallel to the plane of the support, the third elongate member being rotatable about an axis substantially perpendicular to the axis of rotation of the combined page-flattener and ruckler, and adapted, in use, to engage with a surface of the first page.

Conveniently, the axes of rotation of each elongate member are coaxial, and the three elongate members together form a propeller having a single axis of rotation.

By forming the three elongate members as one propeller, movement of the parts of the device is simplified, and sequential operation of each of the three elongate members is readily achieved.

Preferably, the second page-flattener comprises a resilient portion. This allows the second page-flattener to apply a pressure to the page and also to move over a page without damaging the page and without catching an edge of the page.

The second page-flattener may comprise a brush having, for example, nylon bristles. The bristles are able to withstand a compressive and/or bending load during use of the device.

Preferably, the first page-flattener is positionable on the first page at a location towards an outer edge of the page, remote from the spine. The second page-flattener is positionable on the first page at a location spaced apart from the first page-flattener, and towards the spine of the book. This results in the first and any subsequent page being effectively anchored at two fixed points. This in turn provides these pages with maximum resistance to buckling.

Advantageously, the device further comprises an indicator for indicating to a user where to position the first and/or second page flattener.

Preferably, the device comprises a second rotating means for rotating the propeller.

Advantageously, the device comprises a torque limiter for limiting the torque of the propeller. The torque limiter is necessary, in the event that the page turner is unable to turn the page. Once the torque reaches a predetermined level, the rotating means for rotating the propeller will cut out interrupting further rotation of the propeller. This reduces the likelihood of damage to the propeller and the page, as well as reducing damage to a person who may have attempted to interfere with the device by inserting a hand into the device.

Preferably, the device comprises a controller for controlling the first and second rotating means, the detector, and the positioning means.

By means of the controller, the components in the device work sequentially in order to turn the page of the book.

Preferably, the book is clamped to the book support. Advantageously, the device further comprises release means for enabling release of the clamp only when the device support has been moved away from the book support.

In other words, it is possible to release the clamp only if the device support has been moved beyond the page turning position. In this position it is easier to remove the book from the device as there is more space between the book support and the page turner, page flatteners and the ruckler. Preferably, the release means enables release of the clamp only when it is required to remove the book from the device, and not on every occasion that the device support is moved away from the book support.

Preferably, the device further comprises operating means for remotely operating the device. The operating means thus allows a user, who may be physically disabled to control operation of the device from a position remote from the device.

Conveniently, the device may be used in a reverse mode to allowing turning of pages in an opposite sense. In order to achieve reversibility of the device, a motor powering the device is preferably reversible. In addition, the device further comprises means for allowing relative movement between the book and the book support to enable the book to engage with page flatteners, a page turner and a ruckler moving in an opposite direction to the page flatteners, page turner and ruckler described hereinabove.

Preferably, the device is powered by a stepper motor.

Advantageously, the motor powering the device is digitally controlled.

Conveniently, the motor powering the device is controlled by software for controlling the speed and timing of the motor.

In such a system, operation of the motor may be altered by changing the software controlling the motor. Such changes may be carried out remotely.

In addition, a digitally controlled motor may be more readily configured to operate in reverse, than a conventionally controlled motor.

Advantageously, the operation of the device may be remotely or wirelessly controlled. A digitally controlled motor is particularly suitable for remote/wireless control.

According to a second aspect of the present invention, there is provided a method of turning a page of a book the page having an exposed surface and an opposite unexposed surface, the book comprising a spine, and a plurality of pages, the method comprising the steps of:

i) holding the page substantially flat by applying a first pressure to the exposed surface of the page at a first location on an outer edge of the page, and a second pressure at a second location spaced apart from the first location towards the spine of the book;

ii) ruckling the page by applying a third pressure, at the first location directed towards the spine of the book;

iii) detecting a predetermined height of the ruckled first page;

iv) releasing the third pressure once the predetermined height has been reached:

v) applying a fourth pressure to the unexposed surface of the ruckled page, and releasing or reducing the first and second pressures, thereby to turn the page;

Preferably, the method comprises the further step of:

vi) applying a fifth pressure to the page once the turn has been completed.

Steps (i) to (vi) are preferably repeated one or more times to turn the appropriate number of pages in the book.

Preferably, the method comprises the initial step of clamping the book to a support surface. This ensures that the book is securely positioned.

Advantageously the step of holding the page substantially flat comprises applying the first pressure to the page by causing a friction wheel to bear down on the page at a first location towards an outer edge of the page; and applying the second pressure to the page by causing a first elongate member to bear down on the page at a location spaced apart from the first location, towards the spine of the book.

Preferably, the step of ruckling the page comprises rotating the friction wheel so that the third pressure is directed towards the spine of the book.

Conveniently, the fourth pressure is applied to the unexposed surface of the ruckled page by a second elongate member. Further, the fifth pressure may be applied to the page by means of the third elongate member.

The invention will now be further described by way of example only, with reference to the accompanying drawings in which.

Figure 1:
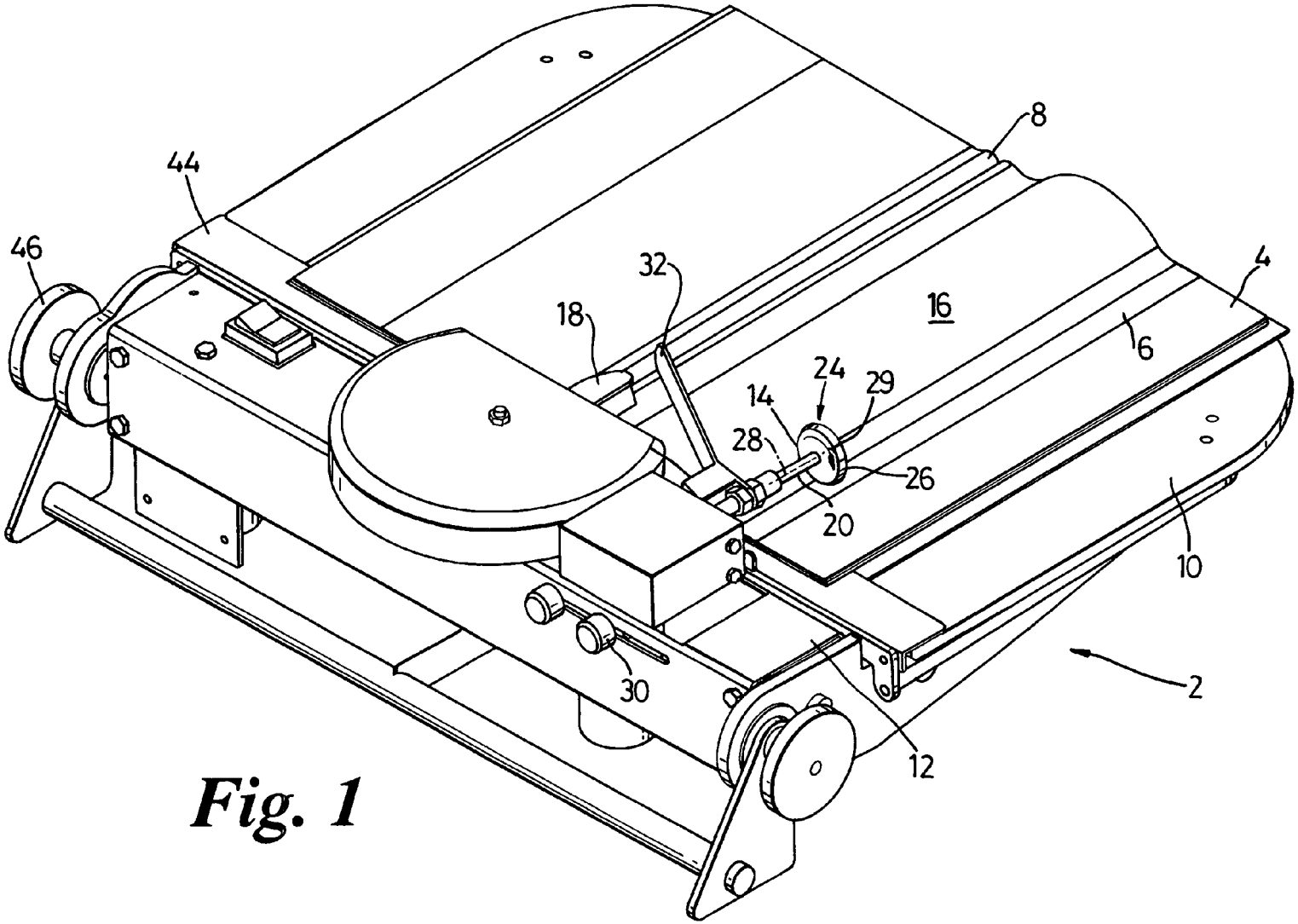
FIG. 1 is a schematic representation of a device according to an embodiment of the present invention for turning pages of a book.
Figures 3A, 3B:
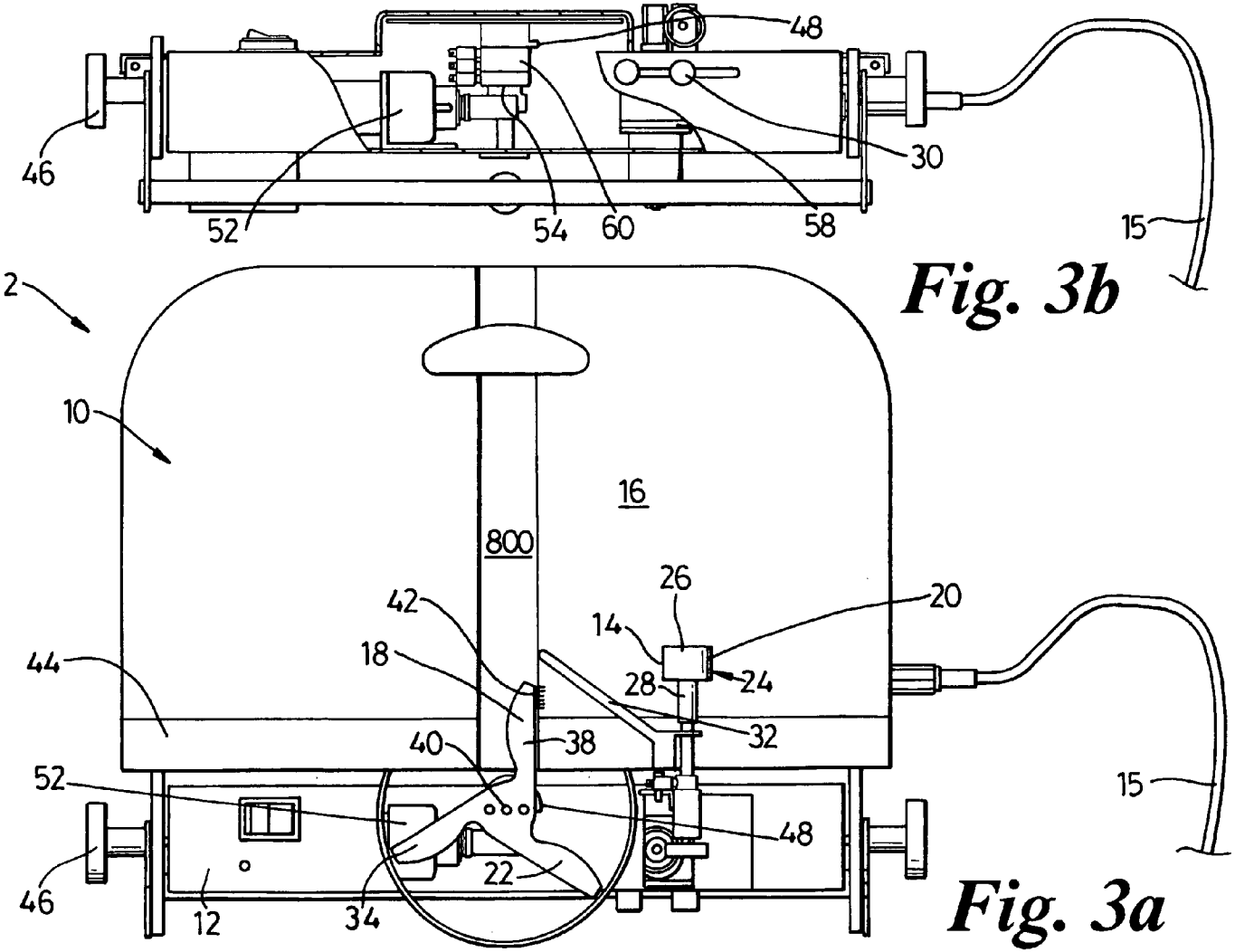

FIG. 3*a* is a schematic plan view of the device of FIG. 1;

FIG. 3*b* is a cross-sectional view of the device of FIG. 3*a;*

Figure 5A:
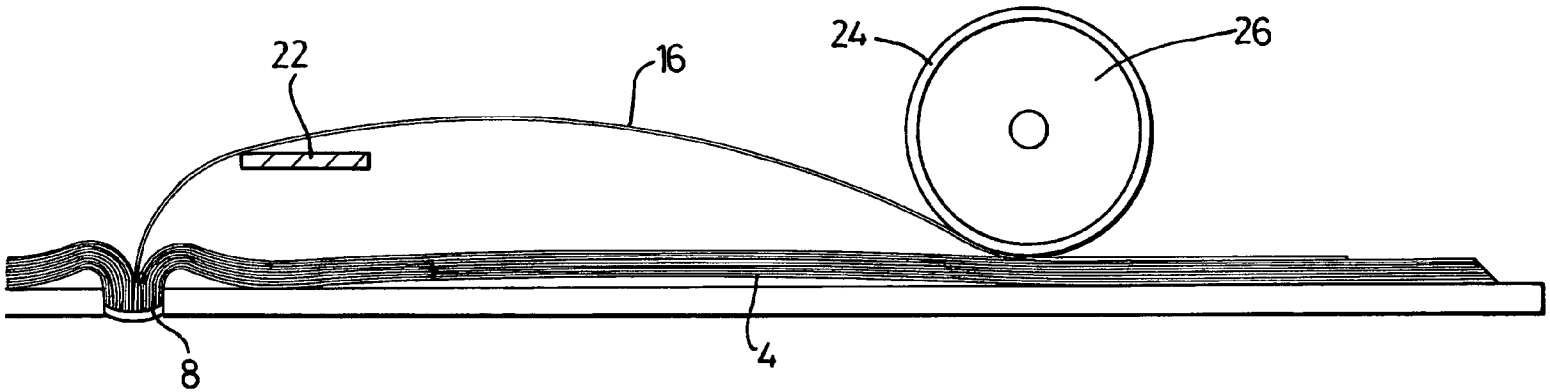
Figure 5B:
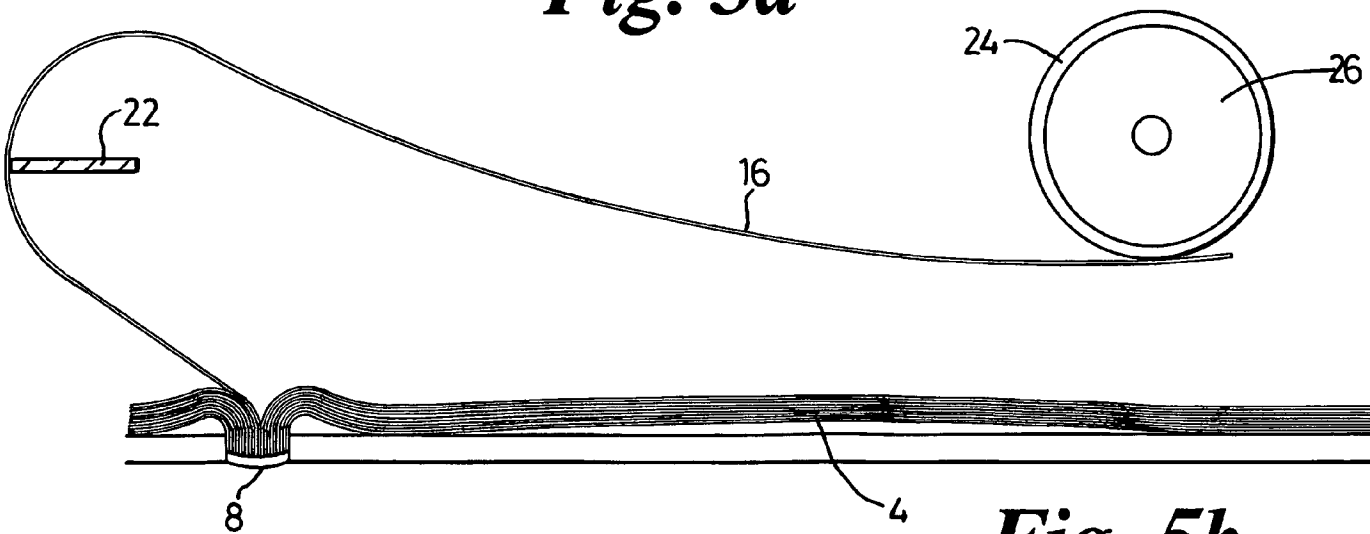
Figure 6:
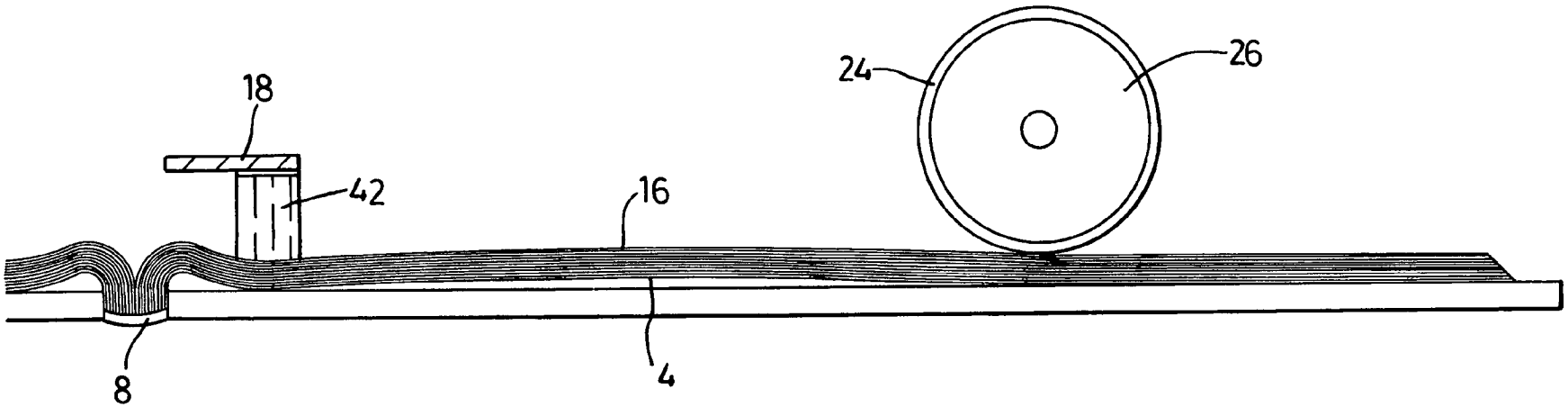
Figure 8:
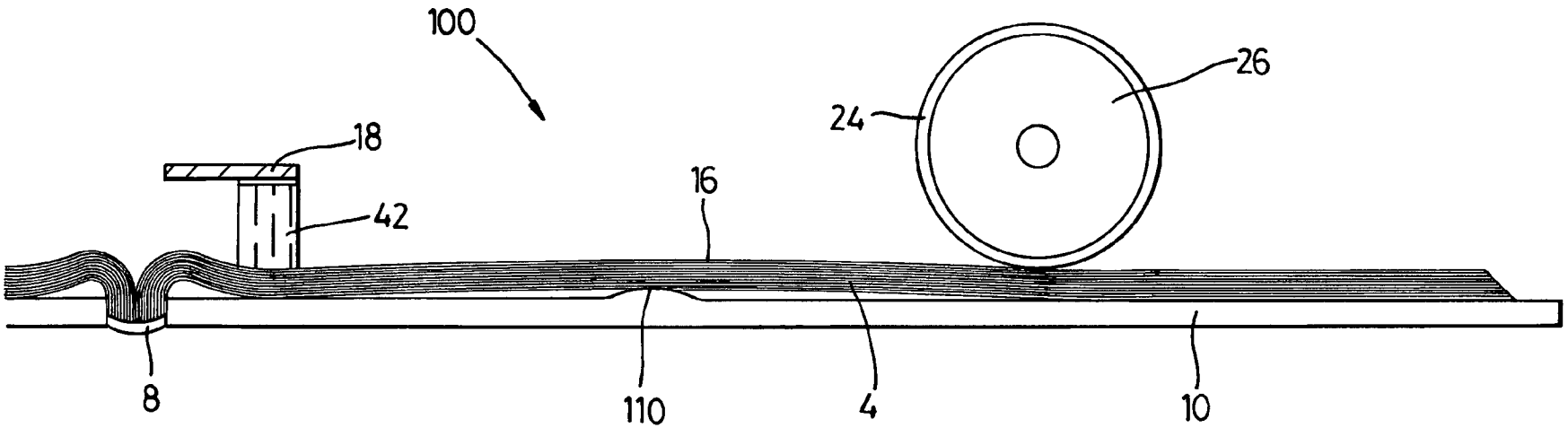

FIGS. 4*a* to 4*f* are schematic plan views of the device of FIG. 1 showing operation of the device;

FIGS. 5*a* and 5*b* are cross-sectional representations of the device of FIG. 1 turning a first page of a book;

FIG. 6 is a cross-sectional representation of the device of FIG. 1 showing the second page-flattener in more detail;

FIGS. 7*a* to 7*d* are schematic representations of the device of FIG. 1 showing operation of the positioning means and clamp;

FIG. 8 is a schematic representation of a portion of a second embodiment of a device according to the present invention in which the book support comprises a raised portion in the form of a rib.

Referring to the figures, particularly FIGS. 1, 2 3*a* and 3*b*, the device according to an embodiment of the invention is designated generally by the reference numeral 2. The device 2 is for turning one or more pages of a book 4. The book 4 comprises a plurality of pages 6 and a central spine 8 supporting the pages 6.

The device comprises a book support 10 on which the book is supported, and a device support 12.

The book support comprises a channel 800 adapted to receive the spine 8 of a book 4.

The device 2 further comprises a first page-flattener 14 for flattening a first page 16 of the book 4, a second page-flattener 18 for further flattening the first page 16, a page ruckler 20 for ruckling the first page to form a ruckled page, and a page turner 22 for turning the ruckled page.

In the embodiment illustrated in the figures, the first page-flattener and the page ruckler formed a combined page-flattener and ruckler 24.

The device 2 further comprises positioning means 48 for moving the device support 12 relative to the book support 10.

The combined page-flattener and ruckler 24 comprises a friction wheel 26 which is adapted to bear down on an exposed surface of the first page 16. The friction wheel 26 is rotatable about an axis 28 that is spaced apart from and substantially parallel to the spine 8 of the book. Rotation of the wheel in a first sense causes the first page to flatten, and rotation of the wheel in an opposite sense causes the first page to ruckle. As shown more clearly in FIG. 2, the first page 16 will ruckle when the wheel 26 is rotated in a sense shown by arrow 29, and will flatten the first page 16 when rotated in the opposite sense.

The device comprises an adjuster 30 for adjusting the lateral distance between the friction wheel 26 and the spine 8 of the book. This enables the device to accommodate books falling within a range of sizes.

The device further comprises a detector 32 for detecting when the height of the ruckled page relative to the book support reaches a predetermined value and a third page-flattener 34 for flattening a second page 36 of the book.

In the embodiment described herein, the second page-flattener 18, the third page-flattener 34, and the page turner 22 each comprise substantially elongate members which are spaced apart from the book support and together form a propeller 38 rotatable about an axis 40.

The second page-flattener 18 comprises a resilient portion 42 which allows the second page-flattener 18 to apply pressure to the first page 16.

In use, a book 4 is positioned on the book support 10. The book may be held in position by a clamp 44. The clamp 44 ensures that the book is secured to the book support whilst allowing the pages 6 to be free to be turned. The clamp is more fully described herein below with reference to FIGS. 7*a* to 7*d.*

The user may then tilt the device 2 by means of tilt adjuster 46, and the device 2 may be held at an appropriate angle to suit the user.

The lateral position of the friction wheel 26 may be altered and locked into position to suit the size of the book 4 by means of adjuster 30. The initial position of the page turner, first and second page flatteners and page ruckler above the book support 10 is set by means of, for example, a spring 74 (FIG. 7*b*) which, acting on the device support, presses the friction wheel against the exposed surface of page 16.

The use of the device will now be described with reference to FIGS. 1, 2, 3*a*, 3*b* and FIGS. 4*a* to 4*f.*

Figure 4A:
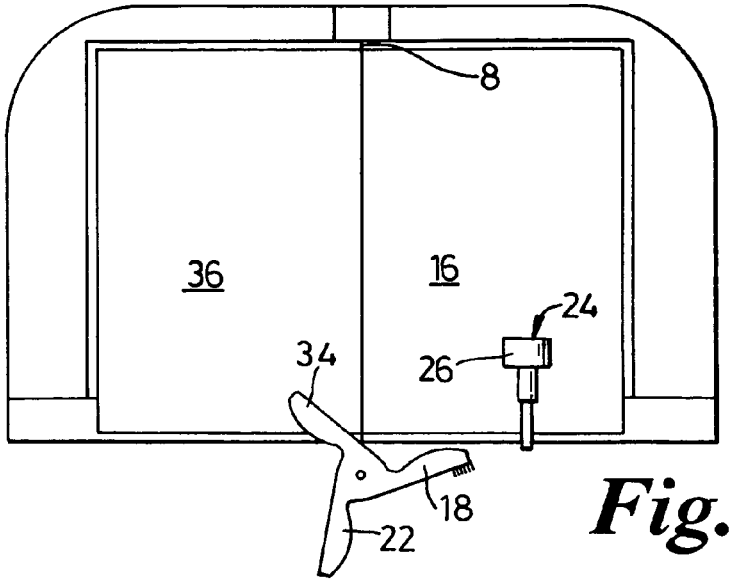

Once the device has been initially set up, the friction wheel 26 will take up the position in FIG. 4*a*, where it serves to flatten the page prior to being turned so that the user may read or view that page. The device may further comprise an indicator for indicating to a user where the friction wheel 26 should be positioned relative to the book 4. When the user is ready to have a page turned, the user is able to activate the device 2 by means of remote operating means 15.

Figure 4B:
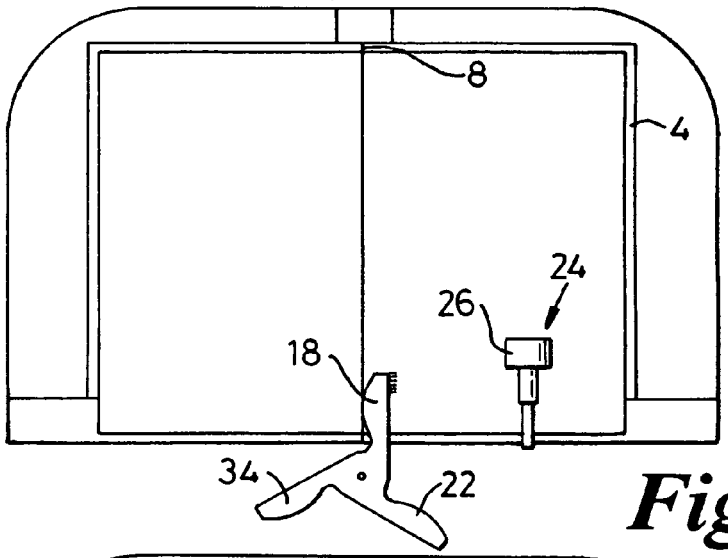

The second page-flattener 18 is then moved into the position shown in FIG. 4*b* through rotation of the propeller 38, where it is spaced apart from the wheel 26 and is positioned close to the spine 8 of the book 4. As the second page-flattener moves into position, the friction wheel 26 rotates so as to continue to maintain the page 16 flat until the page-flattener 18 stops at the position shown in FIG. 4*b*. In this position, the page is fixed at two points defined by the wheel 26 and the second page-flattener 18.

The buckling strength of the first page and any subsequent pages is maximised through the use of the friction wheel 26 and the page flattener 18 by creating a "fixed-fixed" condition for the pages and by flattening the first and any subsequent pages such that they are nearly straight.

The force FX required to ruckle the first page, is a function of the coefficient of friction between the friction wheel 26 and the first page, and the component N of the force, applied to the page by the friction wheel in a direction substantially perpendicular to the page.

The page below the first page also experiences a nearly straight "fixed-fixed" condition, and a force FY tending to ruckle this page is a function of the coefficient of friction between the first page and the page below, and the component of the force N.

FY must be less than the buckling strength of the page below the first page to ensure that none of the pages underlying the first page is ruckled.

The value (FX−FY) must exceed the buckling strength of the first page. For this to happen, the coefficient of friction between the friction wheel 26 and the first page must be significantly higher than the coefficient of friction between the first page and the underlying page.

Figure 2:
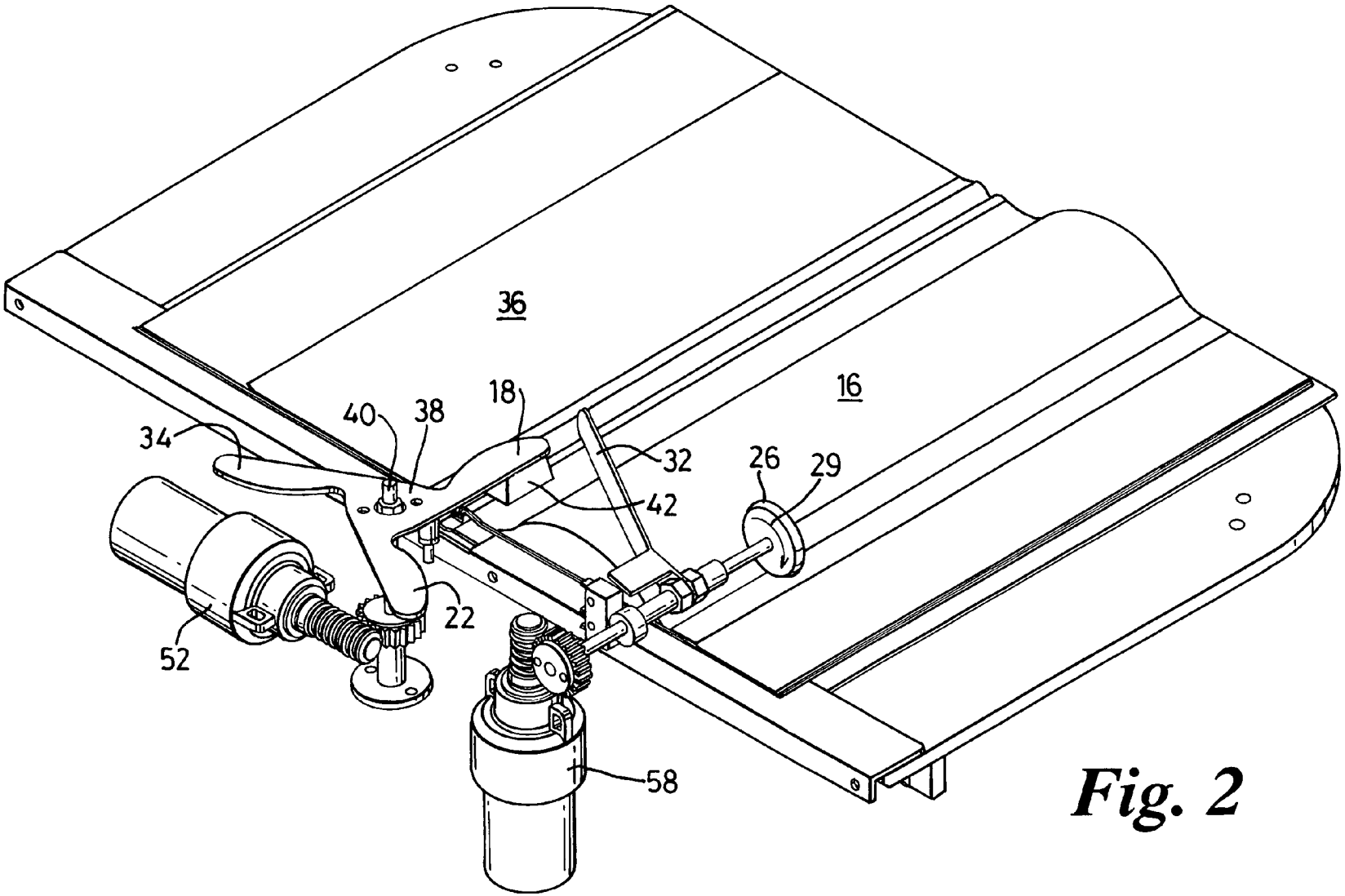
FIG. 2 is a schematic representation of the device of FIG. 1, with part of the device support removed.
Figure 4C:
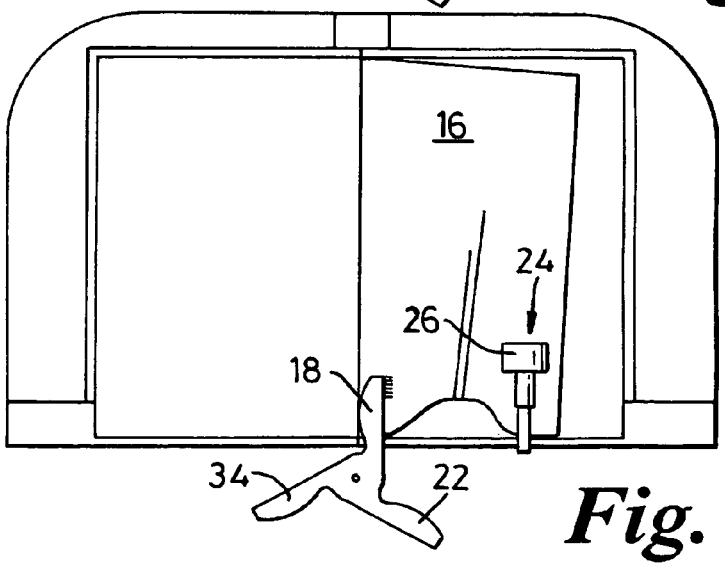

The wheel 26 is then caused to rotate in the sense indicated by arrow 28 in FIG. 2, which causes the page 16 to ruckle as shown in FIG. 4*c*. When the ruckle height reaches a predetermined level sensed by detector 32, wheel 26 ceases to rotate.

Figure 4D:
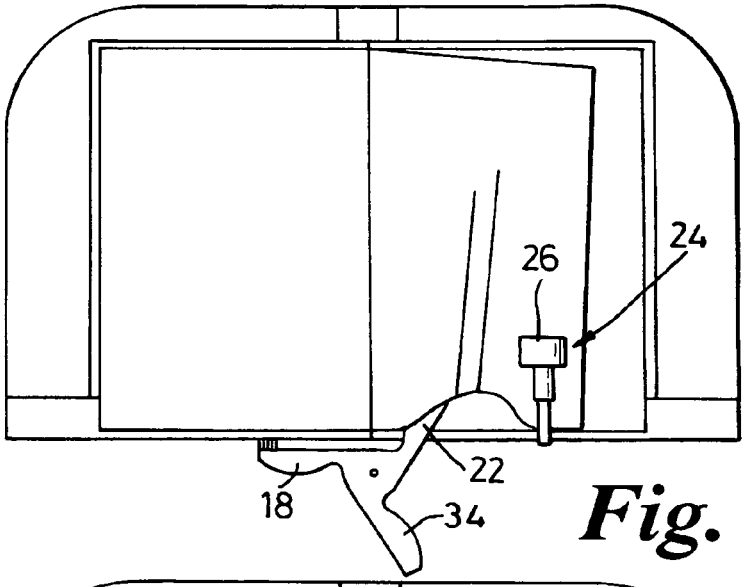

As shown in FIG. 4*d*, the page turner 22 is then moved into a position where it comes into contact with the unexposed surface of the page 16, through further rotation of the propeller 38.

Figure 4E:
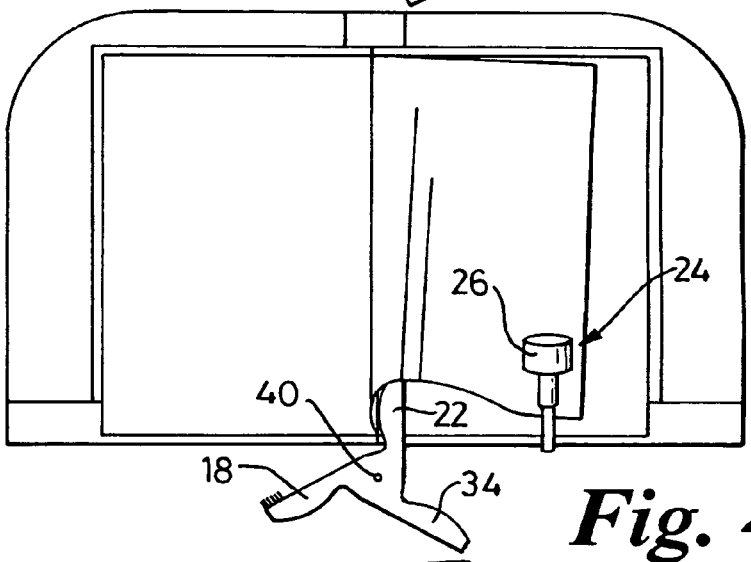

At this point, during continued rotation of the propeller 38, the positioning means 48 lifts the device support 12 relative to the book support causing movement of the page turner 22 and the wheel 26 relative to the book support as shown in FIG. 4*e*.

This has the effect of reducing or releasing the pressure applied to the page 16 by the wheel 26. This also causes the page turner to lift the page 16 and thus to pull the page in a direction which contributes to the page turning process.

Figure 4F:
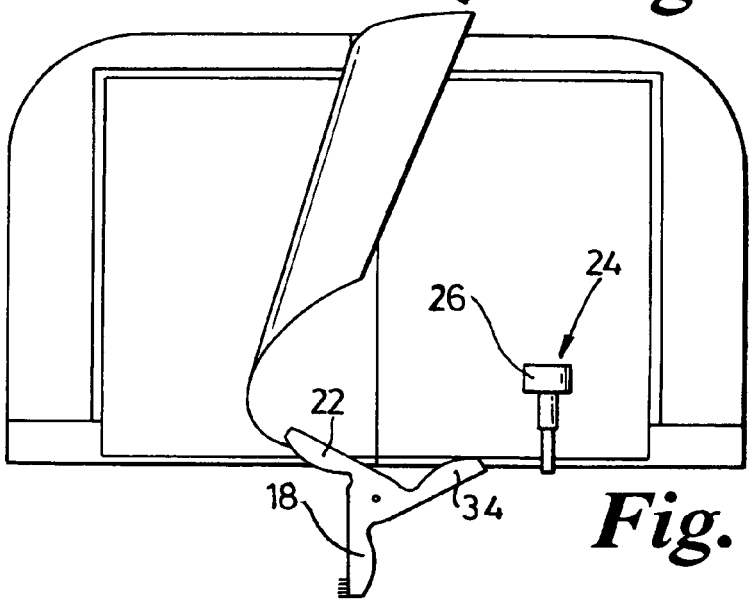

The propeller 38 continues to rotate around axis 40 causing the page turner 22 to pull the page 16 further over, eventually causing the page 16 to turn. As shown in FIG. 4*f*, the positioning means 48 drops the device support 12 relative to the book support. After the page 16 has been turned, it assumes a position shown by page 36 in FIG. 4*a*. The third page-flattener 34 is caused, by further rotation of the propeller 38 to flatten and hold down the newly turned page ready for the user to read or view that page.

Turning to FIGS. 5*a* and 5*b*, the turning of the page by page turner 22 is shown in more detail. When the page turner first begins to pull the page in the manner shown in FIG. 4*e*, the tension on the page 16 is momentarily increased. However, at this point, the positioning means raises the device support 12 relative to the book support 10. This in turn, causes the friction wheel 26 to reduce or release its grip on the page 16, and also causes the page turner 22 to lift the page 16 up further, maintaining a large radius of curvature of the page. This reduces the chances that the page will be ripped or cut by the page turner 22 during the turning process. It also increases the throughput of the page, so enhancing the effectiveness of the page turner 22 in turning the page.

Turning now to FIG. 6, the second page-flattener is shown in more detail. It can be seen that the second page-flattener 18 comprises a resilient portion 42 which enables vertical pressure to be applied to the exposed surface of the page 16.

A rotating mechanism 52 as shown in FIG. 2, rotates the propeller to allow (in sequence) the second page-flattener 18 to provide pressure at a point on the page to be turned to aid the ruckling process, and then to allow the page turner 22 to engage with the ruckled page so as to cause it to turn over, and then finally to allow the third page-flattener 34 to hold the turned page flat. Further, a second rotating mechanism 58 enables rotation of the friction wheel 26.

The device further comprises torque limiting means 54 (see in particular FIG. 3*a*) to prevent potential injury to operators, observers or the book 4, in the event that the propeller 38 is prevented from rotating normally.

Referring to FIGS. 7*a* to 7*d*, use of the clamp 44 and positioning means 48 will be described in more detail.

A spring 74, mounted at one end on the book support 10, applies pressure on the device support 12 via lever 76 and roller 84. The device support 12 comprises a pivot point 78 which passes through the centre of gravity of the device support 12 and all components attached thereto. The device further comprises a base unit 80.

The positioning means 48 comprises a cam 70 which is rotatable around the axis 40 of the propeller 38, and a roller 72 attached to clamp 44. The turning moment about pivot point 78 applied to device 12 by spring 74 via lever 76 and roller 84 causes either the friction wheel 26 to be pressed against the page surface 6 (FIG. 7*b*) or cam 70 to be pressed against roller 72 (FIG. 7*a*) dependent on the angular position of cam 70 in the page turning cycle.

Figure 7A:
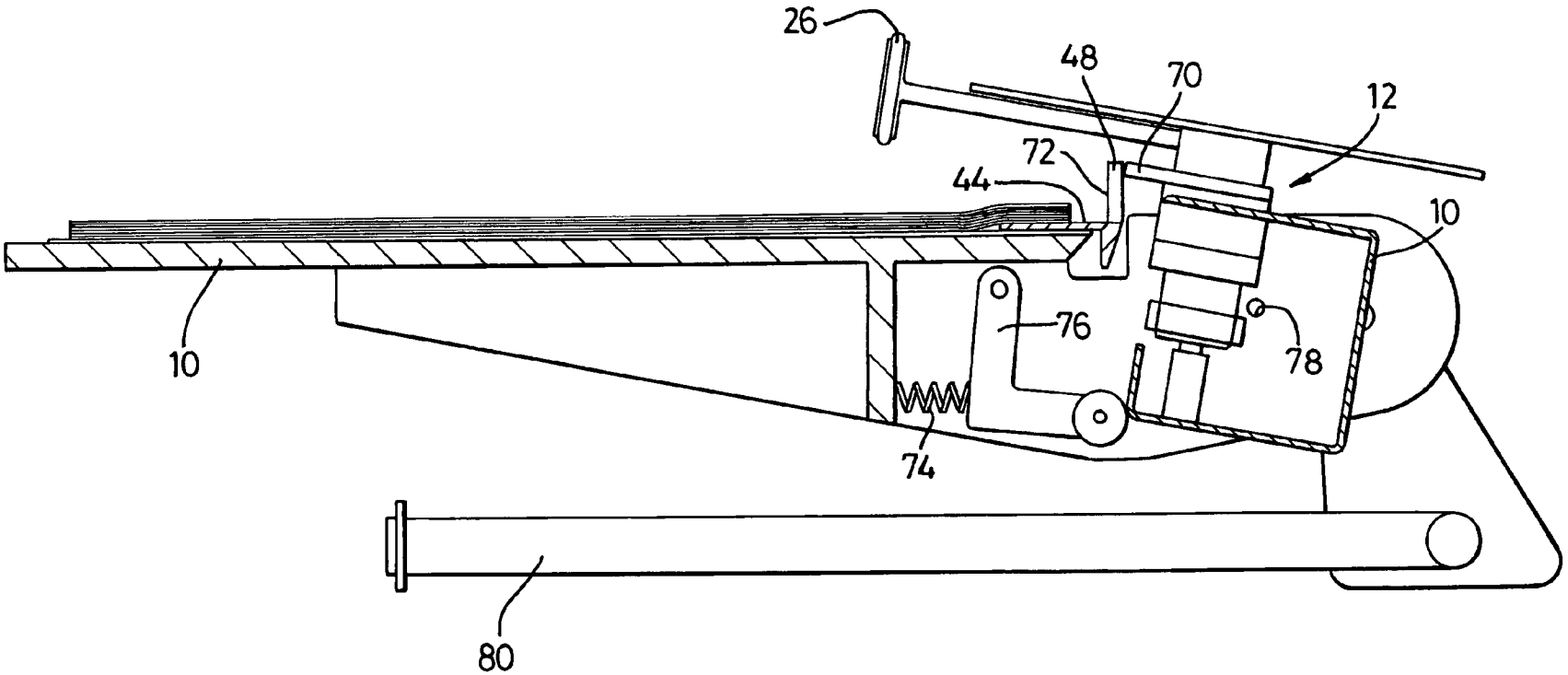
Figure 7B:
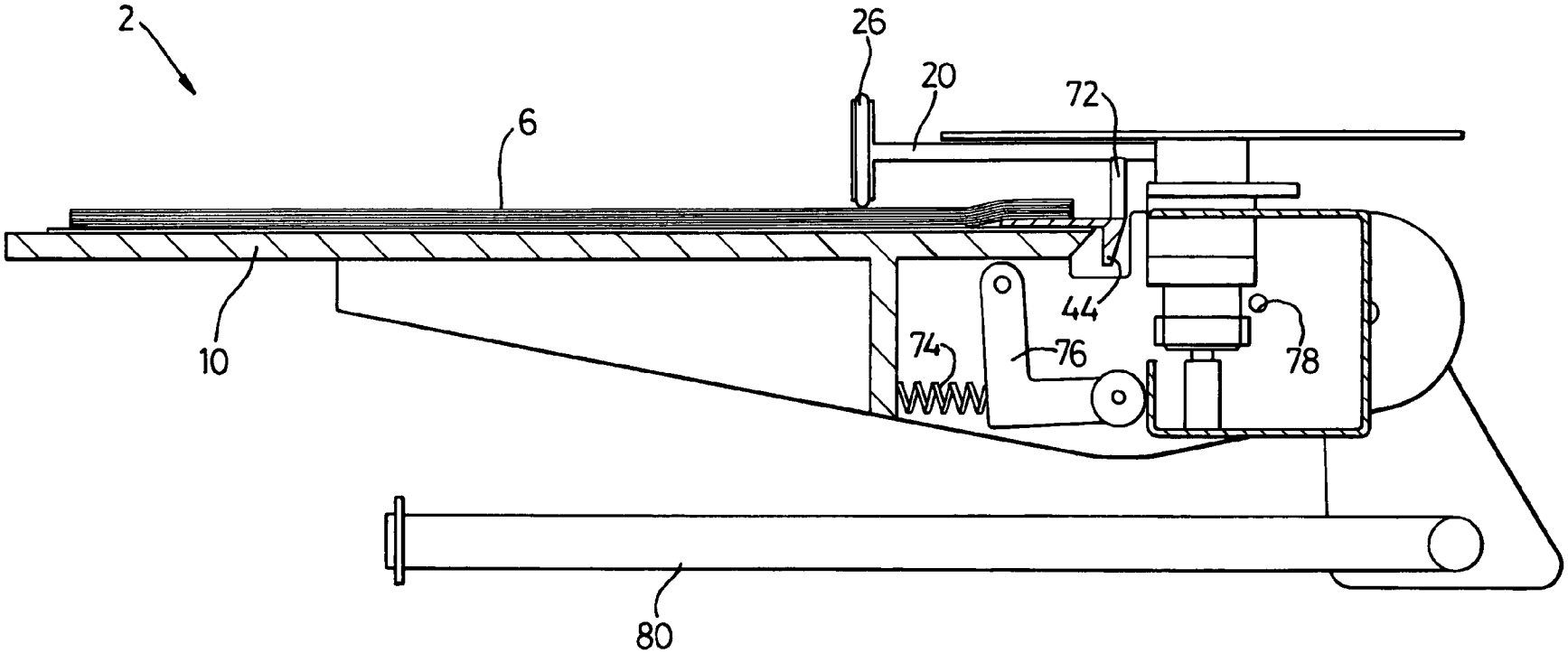
Figure 7C:
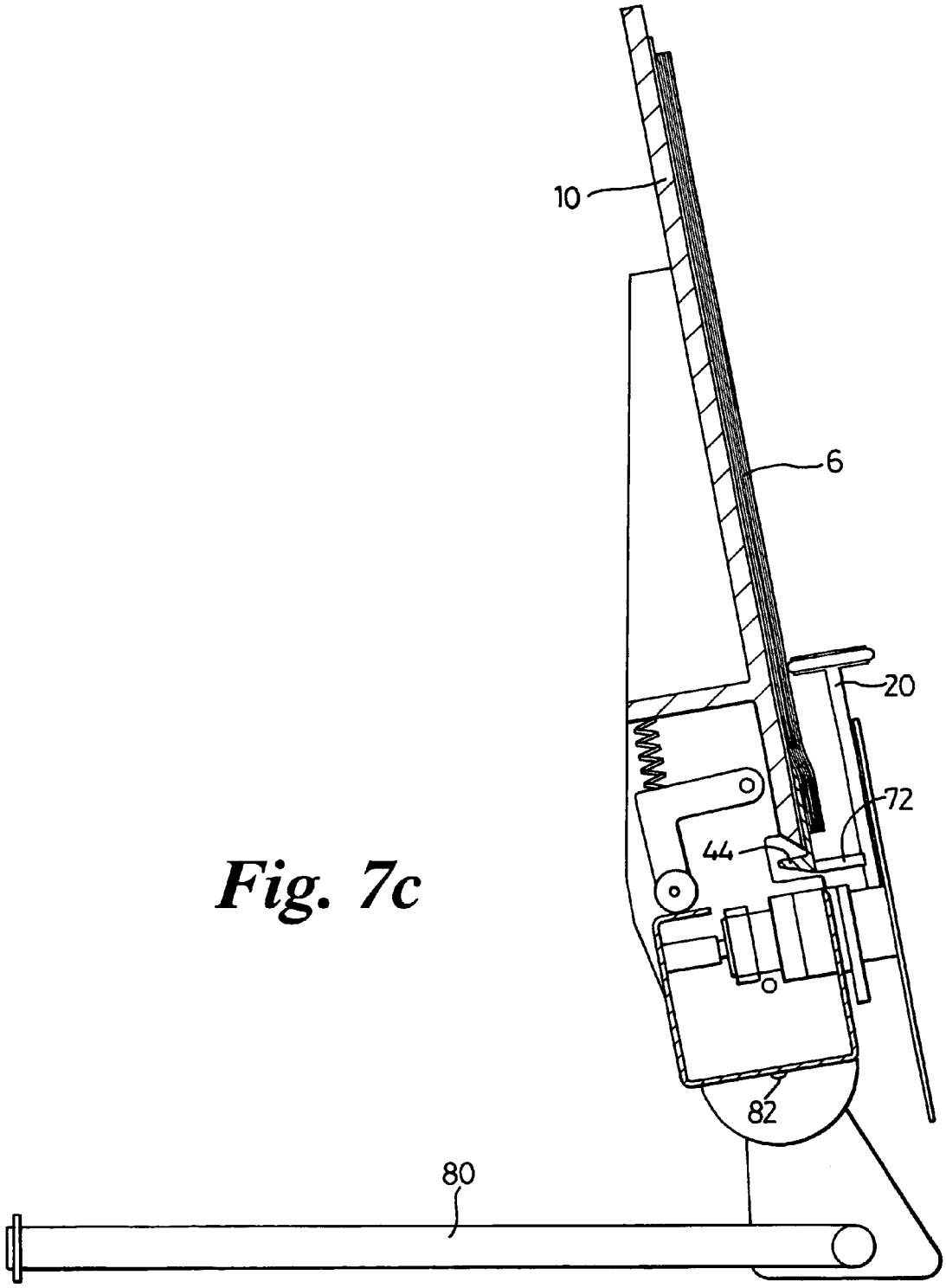

FIGS. 7*b* and 7*c* show the device 2 in a "reading mode" where the friction wheel 26 engages with an exposed surface of a page 6.

When the device 2 is in the reading mode or page turning mode, two spring loaded arms (not shown) maintain the clamp 44 in a position which maintains the book 6 clamped to the book support 10.

FIG. 7*c* shows the device 2 with the book support 10 in an elevated position.

The device support 12 pivots about elevating pivot point 82 in order to assume the elevated position shown in FIG. 7*c*.

Figure 7D:
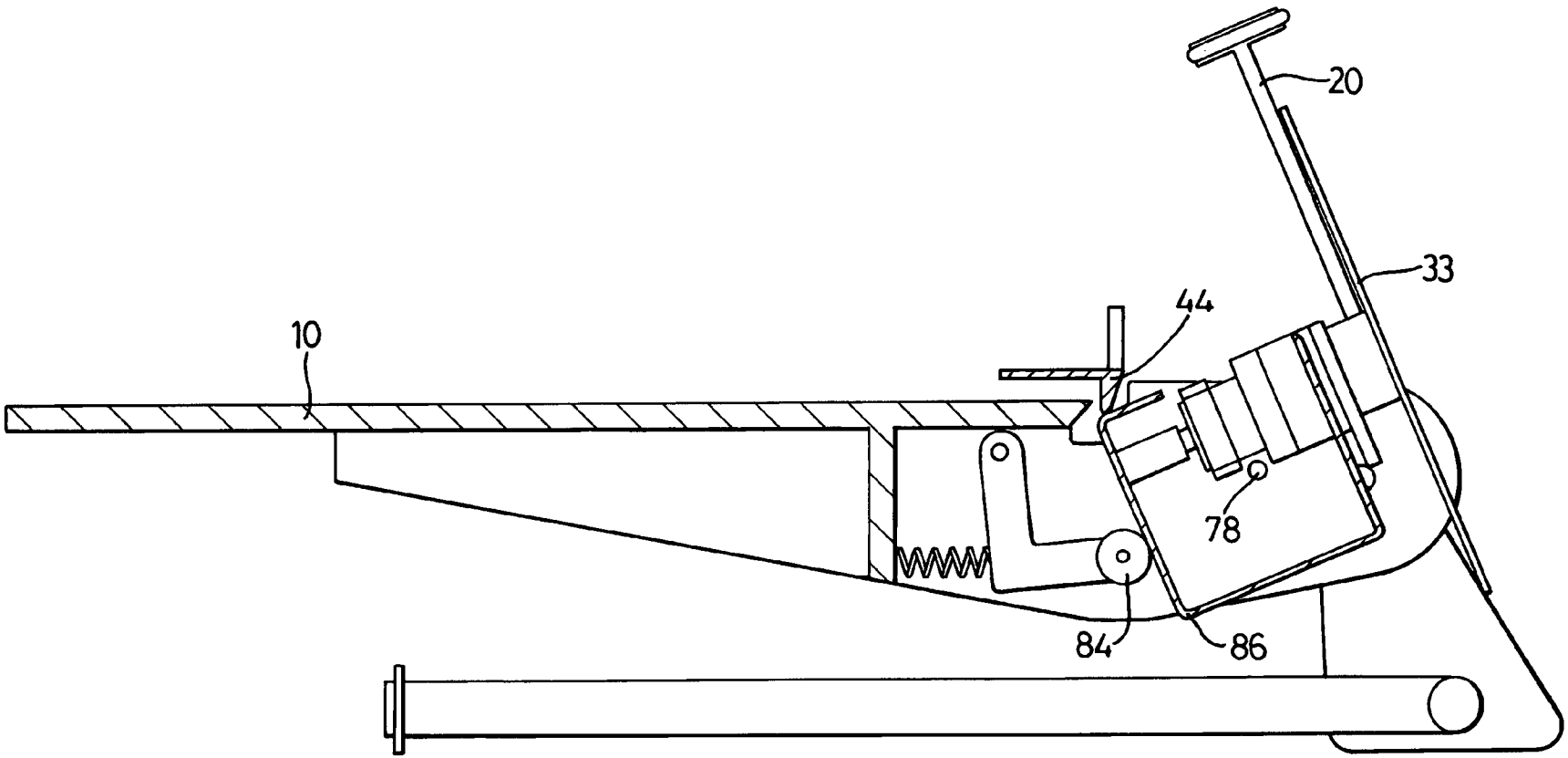

FIG. 7*d* shows the device 2 in a position in which the clamp 44 is released to allow removal of a book 6 from the device 2.

In order to release the clamp 44, the friction wheel 26 is pulled into the position shown in FIG. 7*d*. This causes the device support to pivot about pivot point 78. This in turn causes the spring loaded roller 84 to pass over the corner 86 of the device support 12 which then aids the continued lifting of the friction wheel 26, and holds the friction wheel 26 in the raised position.

In this position, the book clamp 44 has been lifted away from the book support 10 by the device support 12 allowing a book positioned on the book support 10 to be released. Alternatively, a book to be supported on the book support 10 may be inserted into the device. Both the friction wheel 26, and the propeller 38 have been moved clear of the book support 10 to allow free manipulation of a book.

The device 2 further comprises programming means for enabling the operation of the device in a predetermined manner.

Referring to FIG. 8, a portion of the second embodiment of a device 100 according to a second embodiment of the present invention is illustrated schematically. Parts of the second embodiment of the device that correspond to parts of the device illustrated in FIG. 1 have been given corresponding reference numerals for ease of reference.

The book support of the device 100 comprises a protruding portion 110 in the form of a ridge. The presence of the ridge causes the first page 16 of the book 4 to have a slightly convex profile. This enables the first page to be more readily ruckled by the page ruckler.

The invention claimed is:

1. A device for turning one or more pages of a book comprising a plurality of pages, the device comprising:
a book support;
a device support supporting:
a first page-flattener for flattening a first page;
a second page-flattener for further flattening the first page;
a page ruckler for ruckling the first page to form a ruckled page having an exposed surface and an opposite, unexposed surface;
a page turner for engaging with the unexposed surface of the ruckled page thereby to turn the ruckled page;
positioning means for moving the device support relative to the book support,
wherein the first page-flattener comprises the page ruckler, and forms a combined page-flattener and ruckler.

2. A device according to claim 1 wherein the book support comprises a raised portion.

3. A device according to claim 1 further comprising a third page-flattener for flattening a second page.

4. A device according to claim 1 wherein the positioning means comprises a lifter for lifting the device support away from the book support.

5. A device according to claim 1 wherein the book comprises a central spine supporting the plurality of pages and the combined page-flattener and ruckler comprises a friction wheel adapted to bear onto the exposed surface of the first page, which wheel is rotatable about an axis that is spaced apart from, and substantially parallel to the spine, wherein rotation of the wheel in a first sense causes the first page to flatten, and rotation of the wheel in an opposite sense causes the first page to ruckle.

6. A device according to claim 5 further comprising first rotating means for rotating the combined page-flattener and ruckler.

7. A device according to claim 1 wherein the combined page-flattener and ruckler is spaced apart from the book support.

8. A device according to claim 7 further comprising an adjuster for adjusting the lateral distance between the combined page-flattener and ruckler, and the spine of the book.

9. A device according to claim 1 further comprising a detector for detecting when the height of the ruckled page relative to the book support reaches a predetermined value.

10. A device according to claim 1 wherein the second page-flattener comprises a first elongate member spaced apart from the book support, and lying in a plane substantially parallel to the plane of the book support, the first elongate member being rotatable about an axis substantially perpendicular to the axis of rotation of the combined page-flattener and ruckler, and adapted, in use, to bear down on the first page.

11. A device according to claim 1 which further comprises a third page flattener for flattening a second page, wherein the third page-flattener comprises a second elongate member spaced apart from the book support, and lying in a plane substantially parallel to the plane of the book support, the second elongate member being rotatable about an axis substantially perpendicular to the axis of rotation of the combined page-flattener and ruckler, and adapted, in use, to bear down on the second page.

12. A device according to claim 1 wherein the page turner comprises a third elongate member spaced apart from the support, and lying in a plane substantially parallel to the plane of the support, the third elongate member being rotatable about an axis substantially perpendicular to the axis of rotation of the combined page-flattener and ruckler, and adapted, in use, to engage with a surface of the first page.

13. A device according to claim 12 which further comprises a third page flattener for flattening a second page; wherein the second page-flattener comprises a first elongate member spaced apart from the book support, and lying in a plane substantially parallel to the plane of the book support, the first elongate member being rotatable about an axis substantially perpendicular to the axis of rotation of the combined page-flattener and ruckler, and adapted, in use, to bear down on the first page; and the third page-flattener comprises a second elongate member spaced apart from the book support, and lying in a plane substantially parallel to the plane of the book support, the second elongate member being rotatable about an axis substantially perpendicular to the axis of rotation of the combined page-flattener and ruckler, and adapted, in use, to bear down on the second page; and wherein the axes of rotation of each elongate member are coaxial, the three elongate members together forming a propeller having a single axis of rotation.

14. A device according to claim 13 further comprising a torque limiter for limiting the torque in the propeller.

15. A device according to claim 13 further comprising second rotating means for rotating the propeller.

16. A device according to claim 15 further comprising first rotating means for rotating the combined page-flattener and ruckler; a detector for detecting when the height of the ruckled page relative to the book support reaches a predetermined value; and a controller for controlling the first and second rotating means, the detector, and the positioning means.

17. A device according to claim 1 further comprising an indicator for indicating to a user the position of the first and/or second page flattener.

18. A device according to claim 1 further comprising operating means for remotely operating the device.

19. A device according to claim 1 further comprising a motor.

20. A device according to claim 19 wherein the motor comprises a stepper motor.

21. A device for turning one or more pages of a book comprising a plurality of pages, the device comprising:
a book support;
a device support supporting:
a first page-flattener for flattening a first page;
a second page-flattener for further flattening the first page;
a third page-flattener for flattening a second page;
a page ruckler for ruckling the first page to form a ruckled page having an exposed surface and an opposite, unexposed surface;
a page turner for engaging with the unexposed surface of the ruckled page thereby to turn the ruckled page;
positioning; means for moving the device support relative to the book support,
wherein the second page-flattener comprises a resilient portion.

22. A device for turning one or more pages of a book comprising a plurality of pages, the device comprising:
a book support;
a device support supporting:
a first page-flattener for flattening a first page;
a second page-flattener for further flattening the first page;
a page ruckler for ruckling the first page to form a ruckled page having an exposed surface and an opposite, unexposed surface;

a page turner for engaging with the unexposed surface of the ruckled page thereby to turn the ruckled page;

positioning means for moving the device support relative to the book support;

a clamp for clamping a book to the book support.

23. A device according to claim 22 further comprising release means enabling release of the clamp only when the device support has been moved away from the book support.

24. A device for turning one or more pages of a book comprising a plurality of pages, the device comprising:

a book support;

a device support supporting:

a first page-flattener for flattening a first page;

a second page-flattener for further flattening the first page;

a page ruckler for ruckling the first page to form a ruckled page having an exposed surface and an opposite, unexposed surface;

a page turner for engaging with the unexposed surface of the ruckled page thereby to turn the ruckled page;

positioning means for moving the device support relative to the book support;

a motor, wherein the motor is digitally controlled or controlled by software.

25. A method of turning a page of a book the page having an exposed surface and an opposite unexposed surface, the book comprising a spine, and a plurality of pages, the method comprising the steps of:

i) holding the page substantially flat by applying a first pressure to the exposed surface of the page at a first location on an outer edge of the page, and a second pressure at a second location spaced apart from the first location towards the spine of the book;

ii) ruckling the page by applying a third pressure, at the first location directed towards the spine of the book;

iii) detecting a predetermined height of the ruckled first page;

iv) releasing the third pressure once the predetermined height has been reached;

v) applying a fourth pressure to the unexposed surface of the ruckled page, and releasing or reducing the first and second pressures, thereby to turn the page.

26. A method according to claim 25 comprising the further step of:

vi) applying a fifth pressure to the page once the turn has been completed.

27. A method according to claim 26 wherein steps i) to vi) are repeated one or more times in order to turn a plurality of pages.

28. A method according to claim 26 wherein the fifth pressure is applied to the page by means of a third elongate member.

29. A method according to claim 25 comprising the initial step of clamping the book to a support surface.

30. A method according to claim 25 wherein the step of holding the page substantially flat comprises applying the first pressure to the page by causing a friction wheel to bear down on the page at a first location towards an outer edge of the page; and applying the second pressure to the page by causing a first elongate member to bear down on the page at a location spaced apart from the first location, towards the spine of the book.

31. A method according to claim 30 wherein the step of ruckling the page comprises rotating the friction wheel so that the third pressure is directed towards the spine of the book.

32. A method according to claim 25 wherein the fourth pressure is applied to the unexposed surface of the ruckled page by a second elongate member.

33. A control system for carrying out a method as claimed in claim 25.

* * * * *